United States Patent [19]

Ermert

[11] 4,189,707

[45] Feb. 19, 1980

[54] ENGINE AIR INTAKE WARNING SYSTEM

[76] Inventor: Ronald A. Ermert, 7980 Elnakay Dr., Evansville, Ind. 47715

[21] Appl. No.: 912,901

[22] Filed: Jun. 5, 1978

[51] Int. Cl.[2] ..... G08B 21/00

[52] U.S. Cl. ..... 340/60; 340/607; 340/611

[58] Field of Search ..... 340/60, 52 R, 27 R, 340/27 SS, 27 AT, 544, 605, 606, 611, 626, 607; 200/81 R, 81.4, 81.5, 82 R, 83 J; 73/115, 709, 753

[56] References Cited

U.S. PATENT DOCUMENTS

| | | | |
|---|---|---|---|
| 1,853,883 | 4/1932 | Roper | 340/626 |
| 2,834,953 | 5/1958 | Bechberger et al. | 340/60 |
| 3,501,959 | 3/1970 | Womack | 200/83 J |

*Primary Examiner*—Alvin H. Waring
*Attorney, Agent, or Firm*—Wood, Herron & Evans

[57] ABSTRACT

A system for warning an operator when the vacuum in a system, such as a diesel engine air intake system, exceeds a predetermined maximum because of clogging of the air cleaner or other reasons, and when the vacuum falls below a predetermined minimum value indicating loss of air cleaning action as, e.g., because of damage to the air cleaner or because of a hole or leak in the air intake system. The system includes a vacuum gauge having spaced, adjustable electrical contacts, an electrically conductive indicator movable between the contacts, and means responsive to the change in air intake system vacuum to move the indicator; and an electrical circuit having one or more visual or audible warning signal devices. The electrical contacts are connected to the circuit and the indicator is electrically grounded such that when the indicator engages one or the other of the electrical contacts on an unacceptable rise or loss of vacuum, respectively, it closes the circuit to actuate the warning signal device. The electrical circuit may include a pair of signal warning devices actuable independently to signal separately of an unacceptable rise in vacuum and an unacceptable loss in vacuum. The circuit may also include an electrically controlled valve for restricting fuel to the engine on loss of vacuum.

8 Claims, 5 Drawing Figures

ENGINE AIR INTAKE WARNING SYSTEM

BACKGROUND OF THE INVENTION

This invention relates to an engine warning signal system and, more specifically, to a warning signal system for an engine air intake system such as that used with a diesel engine.

The air intake system on a diesel engine lies at the heart of engine operation. It is essential to efficient operation as well as engine life that the air intake system function properly. The air intake system of a diesel engine includes a dry air cleaner for cleaning the air entering the engine. When the air cleaner becomes collapsed or plugged for any of a number of reasons flow of air is restricted which adversely affects operation of the engine. However, an even more dangerous condition exists when the air cleaner becomes damaged or torn or the intake system leaks such that air is entering the engine without being cleaned. Continued operation of the engine under these conditions can cause serious engine damage.

Warning devices for indicating to an operator when the flow of air through the air cleaner has become restricted are known to the art. One such device is a gauge sold by Murphy Special Products Company which includes an electrically actuable warning circuit actuable by movement of an indicator needle to a predetermined vacuum level. Another is a pop-up valve sold by Donaldson Air Filter Company which gives a visual signal of the existence of a high vacuum in the system. However, there has not heretofore been available a warning system for warning an operator when the vacuum in the engine intake system either exceeds a predetermined maximum or falls below a predetermined minimum indicating a loss of air cleaning action. Specifically, there has not heretofore been available a warning system for warning an operator when the air cleaner is damaged or the air intake system is leaking such as because of a loose clamp or a hole in the piping.

Accordingly, it has been among the principal objects of this invention to provide a system for warning an operator when the vacuum in a system either exceeds a predetermined maximum indicating engine inefficiency or falls below a predetermined minimum indicating a problem which could cause serious engine damage.

It has been a further object of the invention to provide a system which is relatively simple for use in pneumatic systems such as an air intake system of a diesel engine.

Another object of the invention has been to provide a relatively simple, electrically operated warning system for a diesel engine which may include visual or audible warning signals and which may include electrically operated means for restricting engine operation on an unexpected loss of vacuum to prevent damage to the engine.

SUMMARY OF THE INVENTION

These and other objects of the invention are accomplished by providing a system for warning an operator when the vacuum in a system such as a diesel engine air intake system exceeds a predetermined maximum because of clogging of the air cleaner or other reason and when the vacuum falls below a predetermined minimum value indicating loss of air cleaning action as, for example, because of damage to the air cleaner or the air intake system. The system includes a vacuum gauge including a pair of spaced, adjustable electrical contacts and an electrically conductive indicator movable between the contacts and responsive to the existing vacuum in the system, and an electrical circuit including one or more electrically actuable warning signal devices. The gauge is connected to the circuit with the indicator needle being electrically grounded such as on an unacceptable rise in the vacuum in the system the needle contacts the upper electrical contact which has been preset to warn the operator when the vacuum has reached a predetermined value. When the needle contacts the electrical contact, the electrical circuit is closed actuating the warning signal. On loss of vacuum in the system, the needle falls off to a zero position on the gauge, contacting a second electrical contact located at a predetermined position. When the needle comes into engagement with the second contact, the warning circuit is closed to warn the operator of the loss in vacuum.

The warning circuit may include both visual and audible warning devices or any combination thereof. Furthermore, in accordance with a preferred form of the invention, the circuit includes an electrically operated solenoid valve in the fuel line for restricting fuel to the engine on loss of vacuum in the air intake system.

Other objects and advantages of the invention will be apparent from the following detailed description taken in conjunction with the accompanying drawings.

DETAILED DESCRIPTION OF THE INVENTION

Figure 1:
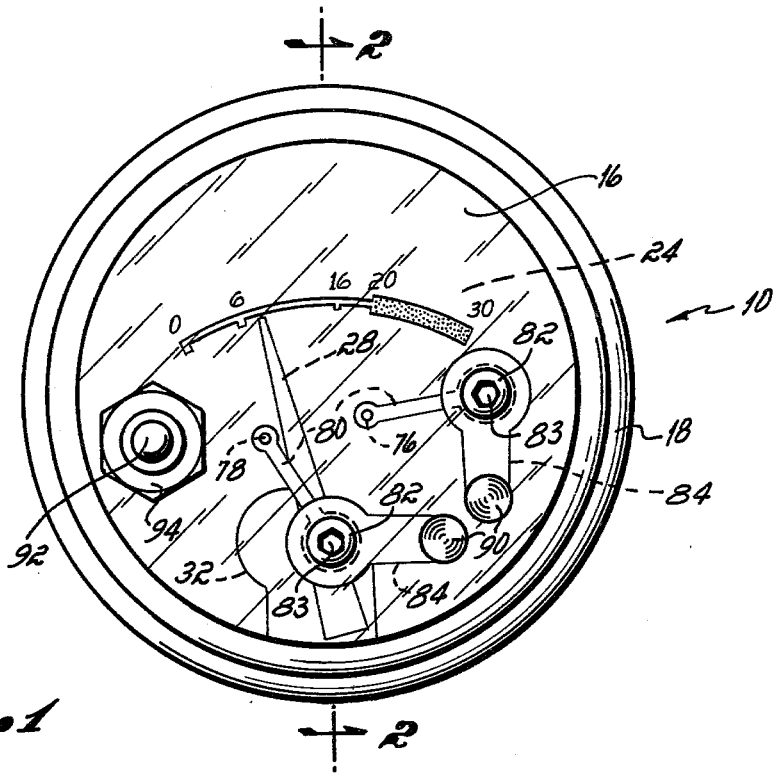
FIG. 1 is a front elevational view of the vacuum gauge forming a part of this invention.
Figure 2:
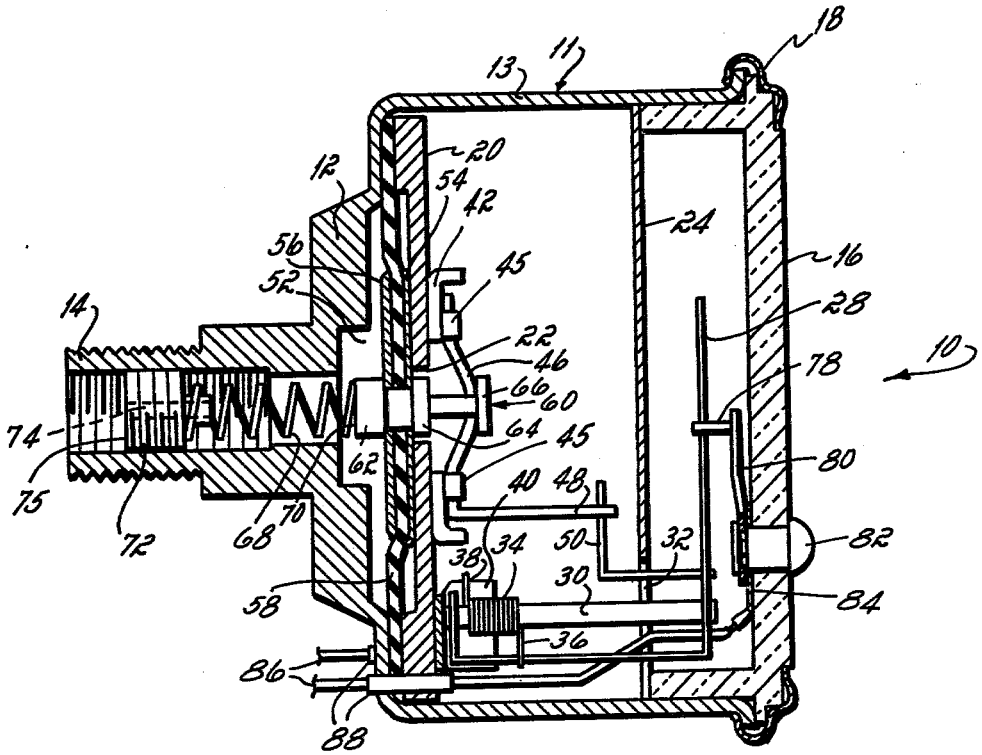
FIG. 2 is a cross-sectional view taken along line 2—2 of FIG. 1.

Referring to FIGS. 1 and 2, a vacuum gauge 10 is shown including a generally cup-shaped case 11 having a rear wall 12, a cylindrical side wall 13, a port 14 communicating with the interior of the case 11 generally centrally through the rear wall 12. A transparent plastic cover 16 closes the front of the case 11, and an annular bezel 18 secures the cover 16 to the case 11. The gauge 10 is so designed for mounting in a circular opening in an operating panel, such as the dashboard of a vehicle, with the bezel 18 engaging the dash in conventional manner. The port 14 is externally threaded to receive a vacuum connecting line 19 (FIG. 3) from the engine. For example, in a diesel engine the vacuum connecting line 19 may be tapped into the engine air intake system between the air cleaner and the engine on a naturally aspirated engine or between the air cleaner and blower on a turbocharged engine.

Within the case 11 is a circular mounting plate 20 secured to the rear wall 12 of the case 11 by means of screws (not shown) passing through the rear wall 12. The mounting plate 20 has a centrally located through opening 22. A circular dial plate 24 is mounted across the case 11 generally perpendicular to the cylindrical side wall 13 of the case 11. The dial plate 24 has appropriate indicia thereon (FIG. 1) visible through the cover 16 for indicating numerically the vacuum in the engine air intake system. With reference to FIG. 1, those elements which are visible only through the transparency of the cover 16 are shown with broken lead lines while those visible from without are shown with solid lead lines.

An indicator 28 is pivotally mounted on a spindle 30 which in turn is secured to the mounting plate 20 and extends through an opening 32 in the dial plate 24. The indicator 28 is so mounted that when it is pivoted it traverses an arcuate section of the dial plate 24 to indicate directly on the dial plate the vacuum in the system, the indicator 28 and dial plate being visible through the cover 16. Referring particularly to FIG. 1, the indicia shown on the dial plate 24 includes a numerical scale extending from 0 to 30 with intermediate points of 6, 16 and 20 to indicate the vacuum in the system in terms of inches of water. The most efficient diesel engine operation is between 6 and 16 inches of water vacuum. Between 16 and 20 inches, engine efficiency drops off significantly. A helical return spring 34 at the base of the spindle 30 has one arm 36 engaging the indicator 28 and the other arm 38 engaging an indicator stop 40 such that the indicator 28 is biased toward the zero position of the dial plate 24. In a normally operating diesel engine air intake system, the vacuum is about 5 to 7½ inches of water. A collapsed or plugged intake system causes an increase in vacuum, and a damaged system results in a decrease in vacuum. In either event, the gauge 10 gives the operator a direct reading of the air flow in the intake system. The stop 40 prevents movement of the indicator 28 off of the scale at both the upper and lower ends of the scale.

Mounted to the plate 20 is a bridge plate 42 and a generally U-shaped bearing plate 44. A crank arm 46 is journalled in the bearing plate 44 at 45 and has an upstanding arm 48 which engages a downwardly depending L-shaped arm 50 secured to the indicator 28 and extending through the opening 32 in the plate 24. The crank arm 46 is diaphragm operated, as described below, and moves in response to and amplifies changes in the vacuum in the system and transmits it to the indicator 28 through the arm 50. On movement of the crank arm 46, the indicator 28 is thereby moved through its arcuate path to indicate directly on the dial plate 24 the then existing vacuum in the system.

The rear wall 12 of the case 11 and the mounting plate 20 define a space 52 which is in fluid communication through the port 14 to the vacuum line 19. Mounted across this space 52 between washers 54 and 56 is a diaphragm 58 which is secured about its periphery between the mounting plate 20 and the wall 12 of the case 11. A diaphragm plunger 60 extends through the washers 54 and 56 and diaphragm 58 and is mounted for movement with the diaphragm 58 by a pair of annular flanges 62 and 64 which engage between them the washers 54 and 56. The plunger 60 has a button 66 at its end extending beyond the mounting plate into the case 11 which engages the crank arm 46. At the other end 70 of the plunger 60 is a coil spring 68 compressed between the flat face of the end 70 of the diaphragm plunger 60 and a spring adjuster 72 in the internally threaded port 14. The spring adjuster 72 has a hole centrally therethrough 74 (shown in phantom in FIG. 2) permitting fluid communication between the space 52 and the open end of the port 14. The coil spring 68 biases the diaphragm 58 toward the mounting plate 20 and thus the diaphragm button 66 out of engagement with the crank arm 46. With the button 66 out of engagement with the crank arm, the return spring 34 biases the indicator 28 to the zero position on the dial plate 24. When a vacuum is drawn through the port 14, the diaphragm 58, which is formed of a flexible material such as Teflon, is drawn toward the port thereby overcoming the force of the coil spring 68 resisting compression and retracting the plunger 60 and diaphragm button 66 along the axis of the port 14. The diaphragm button 66 is thereby brought into engagement with the crank arm 46 rotating it in its journals 45. The linear movement of the plunger 60 translates through the crank arm 46 into rotary movement of the upstanding arm 48, which in turn engages the arm 50 thereby pivoting the indicator 28 on its spindle 30. The vacuum pressure moving the plunger 60 overcomes the spring bias of the return spring 34 permitting movement of the indicator 28 in direct proportion to the degree of vacuum in the system.

The gauge is adjustable to achieve accuracy by adjusting the position of the spring adjuster 72 which in turn adjusts the compression of the spring 68. For example, the spring adjuster 72 may be provided with a slot in its end 75 to receive the working end of a screw driver through the open port 14 for turning the adjuster 72. The adjuster, of course, being threaded into the port 14 moves longitudinally on turning thereby increasing or decreasing the load on the spring 68 depending on the direction in which it is turned.

Attached in fixed relation to the cover 16 and projecting into the case 11 are upper and lower electrical contacts 76 and 78 between which the indicator 28 moves. Each contact 76, 78 is mounted in one end of a contact adjustment arm 80 which is secured at its other end to the cover 16 by means of an Allen rivet 82 extending therethrough. Between the adjustment arm 80 and the interior side of the cover 16 is a tension plate 84 which serves to hold the adjustment arms 80 and their respective contacts 76, 78 in a fixed position while permitting their individual adjustment from without by rotation of the Allen rivet 82. This rotation is accomplished from the cover side of the gauge by inserting an Allen wrench in the Allen recess 83 in the rivet 82 and rotating the rivet in the cover 16.

The positions of the contacts 76, 78 are preset to form upper and lower extremes of movement of the indicator 28. For each contact 76, 78, an 18-gauge electrical wire 86 extends through a nylon insulator 88 mounted in an opening in the rear wall 12 of the case 11 with one end being connected, for example, by crimping or soldering, to a rivet 90 which passes through the cover 16 and secures the tension plate 84 to the cover. Electrical connection between the wires 86 and individual contacts 76, 78 is thereby made through the rivet 90, the tension plate 84, the adjustment arm 80 to the contact. The other end of the wires 86 extends through the wall 12 for connection to the warning system as described below. For purposes of reference the wire connected to contact 76 at the upper end of the scale is designated 86A while the wire connected to the contact 78 at the lower end of the scale is designated 86B.

Figure 3:
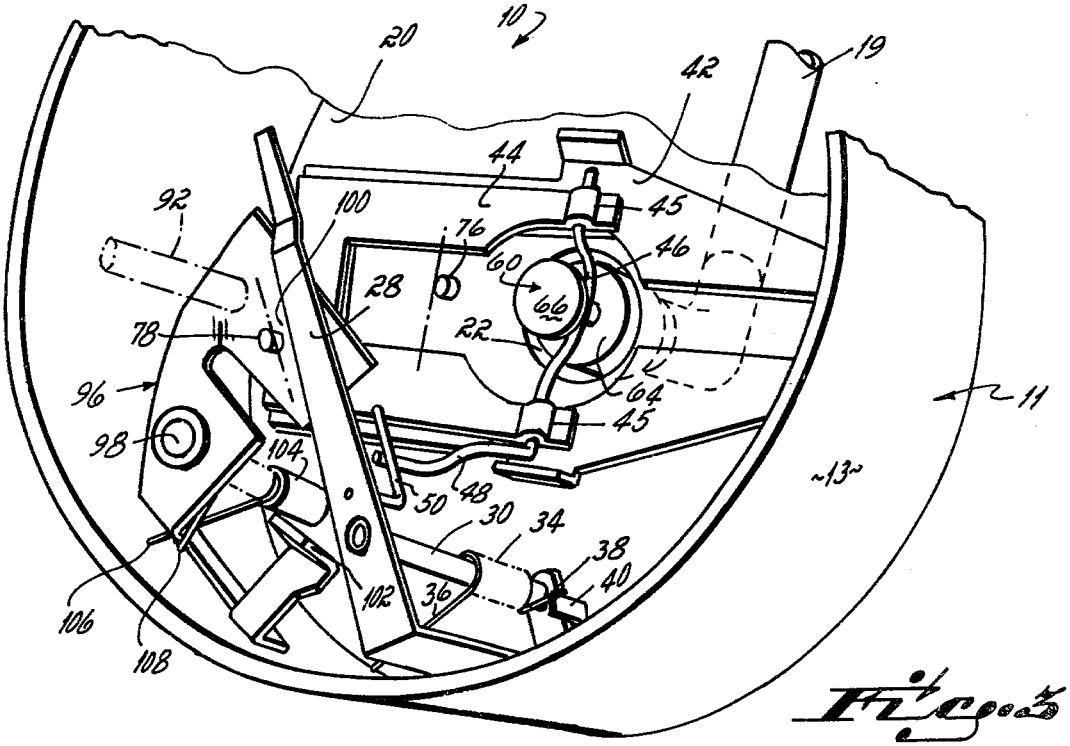
FIG. 3 is an enlarged fragmentary detailed perspective view of the interior of the vacuum gauge shown in FIGS. 1 and 2 with the cover and dial plate removed.

The gauge 10 preferably also includes a reset mechanism at the lower end of the scale for moving the indicator 28 from its spring-biased zero position on initial operation of the engine. The reset mechanism is best shown in FIG. 3 and includes a depressible plunger 92 spring mounted in a body 94 mounted in the cover 16 such that the plunger 92 extends through and out of the face of the cover 16. Within the case 11 is a plate 96 which is pivotally mounted on a spindle 98 and includes a downwardly inclined plane portion 100 located directly below the plunger 92 and an upstanding tang 102 which is operative to engage the indicator 28 and pivot it on its spindle 30 when the reset plate 96 is pivoted counterclockwise on its spindle 98. A return spring 104 is mounted on the spindle 98 having one arm 106 engaging the wall 13 of the case 11 and the other arm 108 engaging the plate 96 to bias the plate 96 to a position wherein the tang 102 is out of engagement with the indicator 28.

The reset mechanism operates in the following manner. When it is desired to move the indicator from its zero position, the plunger 92 is depressed by the operator. Depression of the plunger 92 causes it to engage the inclined portion 100. As the plunger is further depressed the bias of spring 104 is overcome and the plunger travels down the incline causing rotation of the plate 94 in a counterclockwise direction on its spindle 98. Rotation of the plate 94 in turn brings the tang 102 into engagement with the indicator 28 moving it off the zero position. At this point, with the engine operating, the vacuum in the system is sufficient to hold the needle, and the reset may be released.

Figure 4:
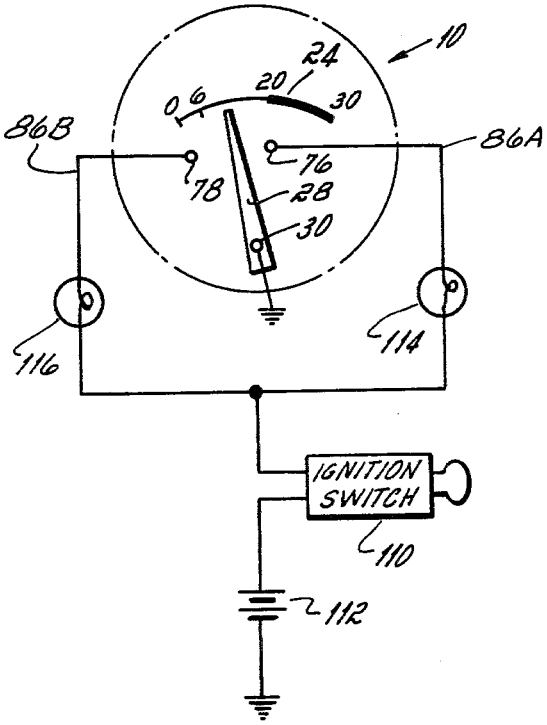
FIGS. 4 and 5 are schematic views of the warning system of the present invention.
Figure 5:
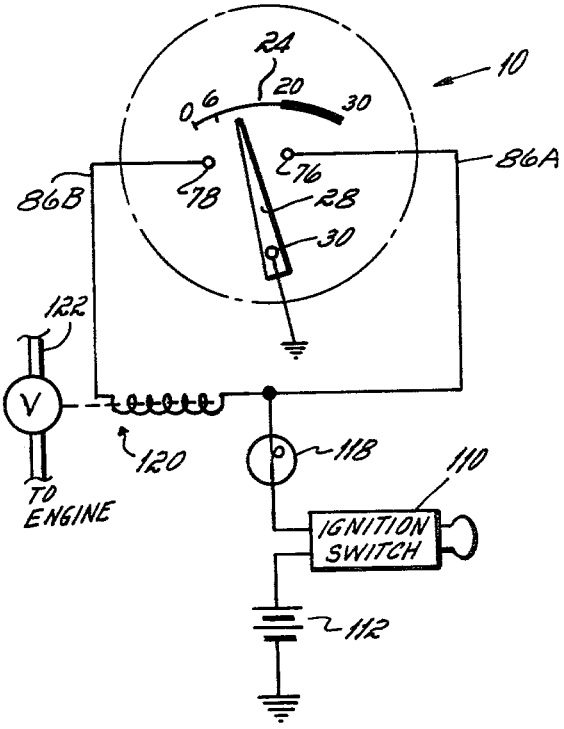

The electric wires 86 form means for connecting the electrical contacts 76, 78 to an electrical warning circuit. Two forms of such a circuit are illustrated in FIGS. 4 and 5. Referring first to FIG. 4, the indicator 28 of the gauge 10 is electrically connected to the case 11 which in turn is grounded to the dash panel of the vehicle. Alternatively, the indicator could be grounded directly. Wires 86A connected to contact 76 and 86B connected to contact 78 are in an electrical circuit through the ignition switch 110 to the positive terminal of the vehicle battery 112. The warning circuit includes a first electrically actuable warning signal device such as a light 114 connected between the contact 76 and the battery 112 and a second light 116 connected between the contact 78 and the battery 112. The lights 114 and 116 are preferably mounted in the dash to form a visual warning signal to the operator. The lights may be color coded such as with a red lens or they may include warning indicia such as "Check Air Cleaner." Alternatively or in addiiton, the circuit could include an audible warning signal such as a buzzer.

In the embodiment shown in FIG. 4, the system operates as follows. On normal engine operation wherein the vacuum in the intake system is in the range of about 6 to 7½ inches of water, the indicator 28 is held in its indicating position by the diaphragm and crank arm assembly previously described. When the filter collapses or becomes plugged, the vacuum in the air intake system rises. This causes the diaphragm 58 carrying the plunger 60 to move more toward the port 14. Movement of the plunger 60 engages the crank arm 46 which in turn moves the indicator up the scale toward the contact 76. The vacuum level at which it is desired to actuate the warning system is preset by adjustment of the position of the contact 76. When the indicator 28 comes into contact with the contact 76, the warning circuit is completed and light 114 is illuminated to warn the operator of the unacceptable engine condition.

On loss of vacuum in the air intake system as, for example, would occur when the filter was damaged, the diaphragm 58 is urged away from the port 14 by the spring 68 thereby moving the plunger 60 out of engagement with the crank arm 46. When this occurs the needle drops toward zero under the action of the return spring 34. The contact 78 is preset at a position to indicate a vacuum level which is unacceptable and at which point it is desired to inform the operator of a dangerous engine condition. When the indicator 28 contacts the lower contact 78, the electrical circuit is likewise completed and the light 116 is illuminated.

Referring now to FIG. 5, an alternative embodiment is shown wherein only a single light 118 is employed to indicate that the operator should check the gauge to determine whether there is an excessively high vacuum or a loss of vacuum in the engine intake system. The warning system in FIG. 5 further includes an electrically operated solenoid valve 120 in the fuel line 122 of the engine which is operative to restrict the fuel to the engine when the indicator 28 contacts the lower contact 78 so that the engine only has enough fuel to idle. That is, when the air filter is damaged air is rushing into the engine without cleaning. This condition is more dangerous to the engine than when the air cleaner is plugged because it permits dirt to enter the engine which would cause serious damage to the engine if operation were continued. In the embodiment shown in FIG. 5, when the indicator 28 contacts the contact 78 on loss of air filtering action, the fuel to the engine is automatically restricted by actuation of the solenoid valve 120 thereby preventing continued operation of the engine above idle. When the air cleaner is repaired and it is desired to restart the engine, the reset plunger 92 is depressed to pivot the reset plate 96 to move the indicator 28 out of contact with the contact 78. This opens the electrical circuit thereby opening the solenoid valve and permitting full fuel flow to the engine. The engine may now be operated, and, when operating, the vacuum in the air intake system is sufficient to hold the indicator needle away from the zero position. The reset plunger 92 is then released.

Although the invention has been described in terms of certain preferred embodiments, it will be recognized that other forms may be adopted within the scope of the present invention. In particular, although the invention has been described as applied to a diesel engine, it will be recognized that it is applicable to any vacuum or fluid system wherein it is desired to warn of an unacceptable use or loss in system vacuum.

I claim:

1. A diesel engine warning system for warning an operator of a diesel engine when a vacuum in the air intake system of the engine exceeds a predetermined maximum or falls below a predetermined minimum vacuum comprising:

a vacuum gauge including a pair of spaced electrical contact means, an indicator movable between said electrical contact means, and means responsive to the vacuum in said engine air intake system for moving said indicator, means for connecting said vacuum gauge to said air intake system of a diesel engine, an electrical circuit which includes at least one electrically actuable warning signal device, and means for connecting said electrical contact means to said circuit, said indicator being movable into engagement with one of said electrical contact means on an increase in vacuum above a predetermined maximum indicating a restriction in said air intake to the engine and into engagement with the other of said electrical contact means on a decrease in vacuum below a predetermined minimum indicating the loss of filtering of the intake air to the engine to actuate said warning signal device to warn said operator of such condition in said air intake system.

2. The system of claim 1 wherein said electrical contact means comprises a pair of spaced contact rivets mounted in adjustment arms whereby the positions of said contact rivets may be adjusted by adjusting said arms.

3. The system of claim 2 wherein said adjustment arms are mounted to a transparent cover closing said gauge and wherein the positions of said contact rivets may be adjusted from without said gauge.

4. The system of claim 1 wherein said means for moving said indicator comprises a diaphragm operated plunger engaging a crank arm.

5. The system of claim 1 wherein said warning signal device comprises a visual warning device.

6. The system of claim 1 wherein said indicator is electrically conductive and is electrically grounded, said electric circuit being completed by contact of said indicator with said contact means.

7. The system of claim 1 wherein said circuit includes an electrically actuable valve in the fuel line to said engine, said valve being actuated when said indicator engages said other of said electrical contact means on a decrease in vacuum below a predetermined minimum to restrict fuel flow to said engine.

8. The system of claim 7, wherein said vacuum gauge further comprises means extending through said cover for mounting each said contact and permitting adjustment of the position of each said contact from the exterior of said gauge and hand-actuable means for moving said indicator out of engagement with one of said contact means.

* * * * *